United States Patent [19]

Ubezio

[11] 4,156,391

[45] May 29, 1979

[54] HEIGHT ADJUSTABLE TABLE

[75] Inventor: Lorenzo Ubezio, Dietikon, Switzerland

[73] Assignee: Reppisch-Werke GmbH, Dietikon, Switzerland

[21] Appl. No.: 916,810

[22] Filed: Jun. 19, 1978

[30] Foreign Application Priority Data

Jun. 27, 1977 [CH] Switzerland ..... 7850/77

[51] Int. Cl.[2] ..... A47B 9/02; F16M 11/00

[52] U.S. Cl. ..... 108/136; 108/2; 108/37; 108/144; 248/123.1; 248/599; 248/162.1; 267/165

[58] Field of Search ..... 108/136, 2, 37, 71, 108/84, 144; 248/123, 162; 267/164, 158, 65, 160, 36 A

[56] References Cited

U.S. PATENT DOCUMENTS

| | | | |
|---|---|---|---|
| 2,828,801 | 4/1958 | Papst | 267/165 X |
| 2,885,067 | 5/1959 | Morris | 267/160 X |
| 2,992,792 | 7/1961 | Van Der Hoek | 267/164 X |
| 3,123,829 | 3/1964 | Bronson | 108/136 |
| 3,131,709 | 5/1964 | Richards | 267/164 X |
| 3,278,153 | 10/1966 | Dallas | 267/160 X |
| 3,283,731 | 11/1966 | Maslow | 108/136 |
| 3,304,892 | 2/1967 | Begtson | 108/136 |

FOREIGN PATENT DOCUMENTS

| | | | |
|---|---|---|---|
| 204286 | 4/1939 | Switzerland | 267/164 |

*Primary Examiner*—James T. McCall

*Attorney, Agent, or Firm*—W. G. Fasse; D. F. Gould

[57] ABSTRACT

The top of a table such as a drafting table which may be adjustable in its elevation, is counterbalanced by counterbalancing elements exerting an approximately constant balancing force. The counterbalancing elements comprise at least one leaf spring forming a bow inserted between the table top and a counter abutment below the table top so that the leaf spring or springs is biassed to form said bow, whereby the load on the bow has a tendency to cause a lateral flexure of the bow. The arrangement is such, that the downwardly directed force component caused by the weight of the table top and the pressure exerted by the bent leaf spring or springs, are directed opposite to each other.

9 Claims, 3 Drawing Figures

HEIGHT ADJUSTABLE TABLE

BACKGROUND OF THE INVENTION

The present invention relates to tables, especially tables the top of which is adjustable in its elevational position, particularly drafting tables or boards or work tables, wherein the table top is supported by weight balancing devices exerting a force of at least substantially constant effect.

Gas springs are frequently used for weight balancing table tops which are adjustable in their elevation. The gas springs are provided with a discharge valve for the purpose of controlling the force exerted by the gas spring. However, if, for example, as a result of controlling the gas spring too much gas is released, it becomes necessary to demount the gas spring and to refill the gas spring to the desired pressure for the further use. Further, the supporting force of gas springs may become weaker with the lapse of time due to leakage. Besides, an increase of the supporting force of a gas spring always makes it necessary to change or demount the spring and to insert a new spring. Gas springs also have a relatively high friction of their own and cause disturbing friction noises when the table top is adjusted in its elevational position.

Other types of weight compensating systems such as tension or pressure springs are not suitable for use in connection with table tops adjustable in their elevational position, because such other devices do not exert a constant force throughout their adjustment range. Such a force is necessary to counteract the weight of the table top.

OBJECTS OF THE INVENTION

In view of the above it is the aim of the invention to achieve the following objects singly or in combination:

to avoid the disadvantages of the prior art, specifically, to avoid the use of gas cylinders for the counterbalancing of a table top;

to counter balance the weight of a table top which is adjustable in its position by relatively simple means which provide a balancing spring force which is constant over a substantially wide range of adjustment;

to provide a counterbalancing device which is easily exchangeable, for example, if a table top of different size or weight is to be used; and to use a leaf spring or a set of leaf springs for the counterbalancing in such a manner that the leaf spring means are secured so as to provide for their lateral flexing.

SUMMARY OF THE INVENTION

According to the invention there is provided an apparatus for counterbalancing the top of a table, which table top is adjustable in its elevational position, comprising leaf spring means, first abutment means secured to said table top at its downwardly facing surface, second abutment means secured to said table below said table top, holding means loosely holding said leaf spring means relative to said abutment means, said first and second abutment means being spaced from each other so as to bend said leaf spring means to form a bow loaded for lateral flexure sufficiently to provide a support pressure effective in a direction substantially opposite to the downward force component exerted by the weight of said table top, whereby the table top is supported by a substantially constant force. The features of the invention provide a relatively simple balancing mechanism for the weight of the table top and such mechanism is not trouble prone at all. The spring force of such a leaf spring bow loaded for lateral flexing or buckling is surprisingly constant over a relatively large adjustment range which is sufficient for normally occurring requirements. In addition, the exchange of the leaf springs is very simple, for example, if a table top having another weight is to be used on the same table base.

BRIEF FIGURE DESCRIPTION

In order that the invention may be clearly understood, it will now be described, by way of example, with reference to the accompanying drawings, wherein.

DETAILED DESCRIPTION OF PREFERRED EXAMPLE EMBODIMENTS

Figure 1:
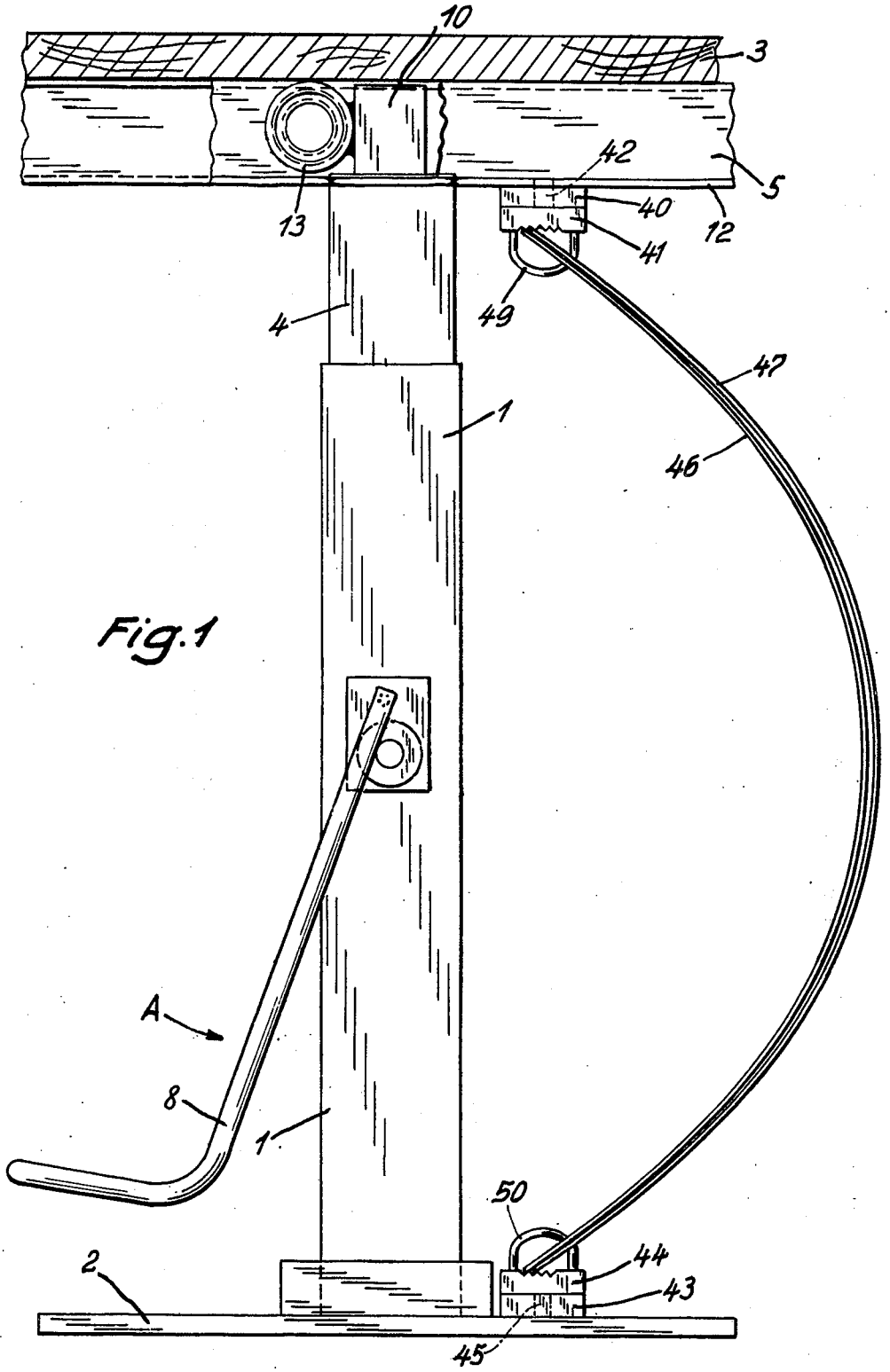
FIG. 1 is a partial side view of a drawing table with a base permitting the elevational adjustment of the table top and equipped with a bow spring according to the invention.

FIG. 1 shows a plate shaped base 2 for the upright post 1 which may be a hollow column extending vertically upwardly and having, for example, a rectangular cross section. The column 1 forms an outer pipe within which an inner pipe 4 having a corresponding cross section fitting into the outer column 1 for vertically adjusting the elevational position of the inner pipe core relative to the outer column 1. A table top 3 is secured to the top of the pipe 4 by conventional means. For example, the lower surface of the table top 3 may be secured to carrier sectional rails 5 of which at least 2 are spaced from each other. A supporting plate 12 is arranged below the carrier sectional rails 5. The table top 3, the carrier sectional rails 5 and the support plate 12 may be tiltably secured to a bearing tubular member 13 for angularly adjusting the position of the table top 3 relative to the horizontal as is conventional in connection with drafting tables. However, it is also possible to rigidly secure the support plate 12 to the top of the inner tubular member 4 as shown, for example, in FIG. 3.

A foot pedal 8 serves to release a conventional brake which is effective on the inner pipe 4. The brake is released when the pedal 8 is pushed in the direction of the arrow A.

Figure 2:
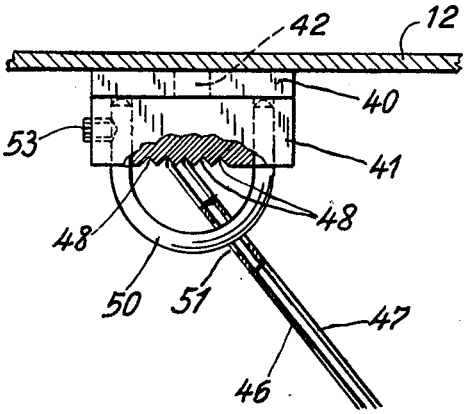
FIG. 2 is a detailed view of the upper abutment means for the leaf spring bow, partially in section.

FIG. 2 shows that according to the invention an abutment block 41 is rotatably secured to the downwardly facing surface of the support plate 12 by means of a vertically extending bolt 42 forming a rotational axis. Preferably, a washer 40 is secured to the support plate 12 between the latter and the abutment block 41. A further abutment member 44 is arranged, or rather, rotatably secured to the base plate 2 by means of an axial bolt 45 which is located substantially in vertical alignment below the abutment member 41 and thus substantially in axial alignment with the bolt 42. Preferably, a further washer 43 is positioned between the base plate 2 and the second abutment member 45.

According to the invention there are arranged leaf spring means, for example, two leaf springs 46 and 47, the ends of which are held in position by the abutment blocks 41 and 44. The length of the leaf springs 46, 47 is such that the springs are loaded to laterally flex or buckle as illustrated especially in FIG. 3. In order to define the contact position between the abutment blocks 41 and 44 on the one hand and the ends of the leaf springs, the abutment blocks 41, 44 are provided with grooves 48 having a serrated cross section wherein the ends of the leaf springs rest. Holding means in the form of bails 49 and 50 are secured to the abutment blocks 41 and 44 respectively. These bails extend with play through slots or elongated holes 41, 52 in the ends of the leaf springs 46, 47, whereby the bails 49, 50 hold the ends of the springs in the grooves 48, thereby preventing that the biassed leaf spring bows jump out of the grooves 48. The bails 49, 50 are held in position by means of set screws 53.

Due to the just described holding of the spring bows 46, 47, the ends of the springs are not tightly clamped but the biassing force of the springs presses the ends of the springs loosely against the grooves 48. The individual leaf springs 46, 47 are not connected to each other. The ends of the leaf springs 46, 47 are tapered in the manner of a cutting edge to properly fit into the respective groove 48. It is advantageous that the spring bow is formed by two metal leaf springs 46, 47 which will be satisfactory for many purposes. However, in order to make it possible that drafting machines of different weigths may be used on the drafting table or to use table tops of different weights, it is possible to use springs arranged in a package and comprising a plurality of springs, preferably of different thicknesses. Such springs may be exchangeable one against another. Preferably, the spring packages or sets of springs comprise several springs having different buckling strengths adjusted relative to each other in accordance with a geometric progression or sequence. Thus, for example, a set of four springs may be assembled of which the first spring has a buckling strength of 20 kg, whereas the second spring has a buckling strength of 10 kg, and the third spring has a buckling strength of 5 kg while the fourth spring has a buckling strength of 2.5 kg.

Figure 3:
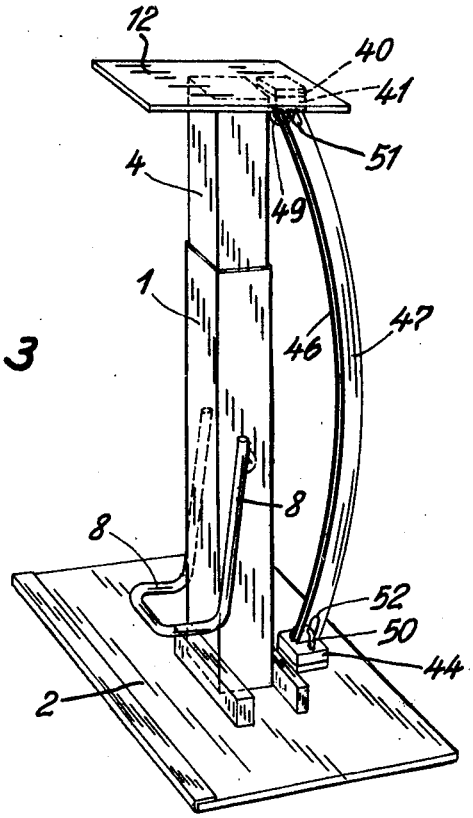
FIG. 3 is a perspective view of a table base, for example, for a drafting table, with the table top removed.

Due to the fact that the abutment blocks 41 and 44 are rotatable about the respective axle bolts 42, 45, it is possible to tilt the spring bow from the position shown in FIG. 1 in one or the other direction through an angle of about 120°. This has the advantage that the table support may be adapted to the available space. Thus, in FIG. 3 the spring bow is shown in the tilted position, whereby it does not extend beyond the base 2 as shown in FIG. 1. In FIG. 3 the spring bow 46, 47 is tilted by about 90° relative to the position shown in FIG. 1.

It has been found, that it is possible to provide a relatively large adjustment range throughout of which the supporting force is constant by using a spring bow 46, 47 the springs of which are loaded for lateral flexure or buckling. Thus, it is possible to move or adjust the table top 3 after releasing the brake by actuating the pedal 8. Such adjustment of the table top may be accomplished within the adjustment range by exerting a very small force. The maximum elevational position or range of the inner pipe 4 is so selected that even in this maximum position of the talbe top the spring bow is never totally stretched out. On the other hand, when the table top is in its lower elevational position, the elasticity limit of the springs must not be exceeded.

A specific example embodiment of apparatus according to the invention comprises leaf springs having a stretched out length of 1200 mm. The spacing between the abutment blocks 41 and 44 in the topmost position of the table top 1150 mm for the just mentioned length of springs. The spacing between the abutment blocks in the lowermost position of the table top is 700 mm thus providing for a stroke of 450 mm.

Although the invention has been described with reference to specific example embodiments, it will be appreciated, that it is intended to cover all modifications and equivalents within the scope of the appended claims.

What is claimed is:

1. An apparatus for counterbalancing the top of a table, which table top is adjustable in its elevational position, comprising leaf spring means, first abutment means secured to said table top at its downwardly facing surface, second abutment means secured to said table below said table top, holding means loosely holding said leaf spring means relative to said abutment means, said first and second abutment means being spaced from each other so as to bend said leaf spring means to form a bow loaded for lateral flexure sufficiently to provide a support pressure effective in a direction substantially opposite to the downward force component exerted by the weight of said table top, whereby the table top is supported by a substantially constant force over a wide adjustment range.

2. The apparatus of claim 1, wherein said leaf spring means comprise a plurality of exchangeable leaf springs arranged in a package and disconnected from each other.

3. The apparatus of claim 2, wherein said leaf springs exchangeably arranged in a package have different thickenesses.

4. The apparatus of claim 1, wherein said first and second abutment means comprise respective vertical journal axis means whereby said leaf spring means may be rotated about said journal axis means.

5. The apparatus of claim 1, wherein said holding means of said first and second abutment means comprise groove means for holding said leaf spring means.

6. The apparatus of claim 5, wherein said groove means have a serrated cross section.

7. The apparatus of claim 6, wherein said leaf spring means have slanted ends which fit into the respective serrated groove means.

8. The apparatus of claim 1, wherein said leaf spring means comprise slot means adjacent to each end, said slot means extending through the leaf spring means, each of said first and second abutment means comprising block means and said holding means comprising bail means secured to the respective block means, said bail means extending through the corresponding slot means with sufficient play.

9. The apparatus of claim 8, wherein said block means comprise groove means therein whereby said leaf spring means with their respective ends rest in said groove menas.

* * * * *

UNITED STATES PATENT OFFICE

CERTIFICATE OF CORRECTION

Patent No. 4,156,391 Dated May 29, 1979

Inventor(s) Lorenzo Ubezio

It is certified that error appears in the above-identified patent and that said Letters Patent are hereby corrected as shown below:

In item "[73] Assignee: Reppisch-Werke GmbH, Dietikon, Switzerland"

should read:

--[73] Assignee: Reppisch-Werke AG, Dietikon, Switzerland--.

Signed and Sealed this

*Twenty-eighth* Day of *August 1979*

[SEAL]

*Attest:*

*Attesting Officer*

LUTRELLE F. PARKER

*Acting Commissioner of Patents and Trademarks*